United States Patent [19]

Nelson

[11] 3,953,034

[45] Apr. 27, 1976

[54] LASER BEAM GOLF SWING TRAINING DEVICE

[76] Inventor: Rodney L. Nelson, Box N, Falls Creek, Pa. 15840

[22] Filed: Apr. 7, 1975

[21] Appl. No.: 565,946

[52] U.S. Cl. ..... 273/186 C; 250/199; 35/29 A; 273/194 A; 240/105

[51] Int. Cl.[2] ..... A63B 69/36

[58] Field of Search ..... 273/183, 186, 193, 194; 35/29 A

[56] References Cited

UNITED STATES PATENTS 3,802,709 4/1974 Elkins ..... 273/186 A 3,863,933 2/1975 Tredway ..... 273/186 A

*Primary Examiner*—George J. Marlo

*Attorney, Agent, or Firm*—Strauch, Nolan, Neale, Nies & Kurz

[57] ABSTRACT

A laser beam golf swing training device including a laser beam source mounted on or within the shaft of a golf club and a convex mirror located on the golf club head between the club face and hosel to spread a laser beam into a fan of light and project the same forwardly and downwardly at a 90° angle to the golf club face so that the golfer sees a line of light on the ground as the ball is hit which tells the golfer whether the ball will be hit straight, or hooked, or sliced.

7 Claims, 4 Drawing Figures

LASER BEAM GOLF SWING TRAINING DEVICE

BACKGROUND OF THE INVENTION

There are many devices patented and otherwise which are designed to improve the golfer's swing whereby he overcomes the problems of hooking or slicing the ball and consequently improves his game. A popular form of swing training aid is a light located on the golf club head or adjacent the head on the hosel which traces an arc of light as the club is swung to impart a mental image to the golfer of the precise path of travel of the golf club head.

The following patents represent a selective sample taken from a large number of prior art patents disclosing similar devices and are represented to be only a sample. U.S. Pat. No. 3,070,373 issued to Donald K. Mathews et al discloses a light source attached to the golf club hosel projecting a collimated pencil beam of light downwardly onto the ground just ahead of the club and between the golfer and golf ball so that a visually perceived trace of club travel is given so that golfer and or instructor are informed of the correctness, or lack thereof, of the golfer's swing. The device is powered by a large battery pack resting on the ground. Two lights attached to the top of the club and arranged on a line at 90° to the club face are disclosed in U.S. Pat. No. 3,191,939. The visual image conveyed during the swing comprises two arcs defined by the paths of the two lights which, if the paths coincide at the moment of impact of club against ball, indicate a proper stroke. If the paths diverge, a hook or slice and the amount thereof is indicated.

U.S. Pat. No. 3,677,553 issued to Eric D. Moore and U.S. Pat. No. 3,820,795 issued to David L. Taylor disclose club head lights indicating the golfer's swing, the latter further disclosing a battery for the light mounted within the golf club shaft. The use of ultraviolet light and luminescent strips on the golf club head or chemical light on the club head is disclosed in U.S. Pat. No. 3,649,028 issued to Eugene N. Worrell.

The prior art does not disclose a laser beam light source and convex mirror arrangement for projecting a fan of light forwardly of the club face to display a line on the ground just before, at the moment of impact, golf club and ball, and slightly afterwards to impart a substantially instantaneous visual impression of correctness or deviation of stroke. Thus, the present invention departs from the prior art methodology of relying on the stroboscopic effect of moving light and the persistence thereof in the mind of the viewer for analyzing the golfer's swing.

SUMMARY OF THE INVENTION

Therefore, it is a principal object of the invention to provide a golf swing training device for projecting a line of light forwardly of the golf club head at the moment of impact of club against ball which indicates a correct, true swing, when the line is at a 90° angle to the golf club face, or slice or hook deviation therefrom, when the line is skewed from the face of the club.

It is an object of the invention to provide a golf swing training device employing a laser beam and convex mirror arrangement to project a golf swing indication reference on the ground when the golf club hits the ball.

It is another object of the invention to provide a golf swing training device for projecting a visual swing reference indication which may be attached to a standard golf club or built into the golf club.

It is yet another object of the invention to provide a golf swing training device for projecting a visual reference line which is visible even in bright sunlight.

It is a further object of the invention to provide a golf swing training device for projecting a visual reference line which may be marketed through golf pro shops and easily attached to standard golf clubs by personnel who need only minimal training in properly mounting the device for use.

Further novel features and other objects of this invention will become apparent from the following detailed description, discussion and the appended claims taken in conjunction with the accompanying drawings.

BRIEF DESCRIPTION OF DRAWINGS

Preferred structural embodiments of this invention are disclosed in the accompanying drawings in which.

DESCRIPTION OF THE PREFERRED EMBODIMENTS

Figure 1:
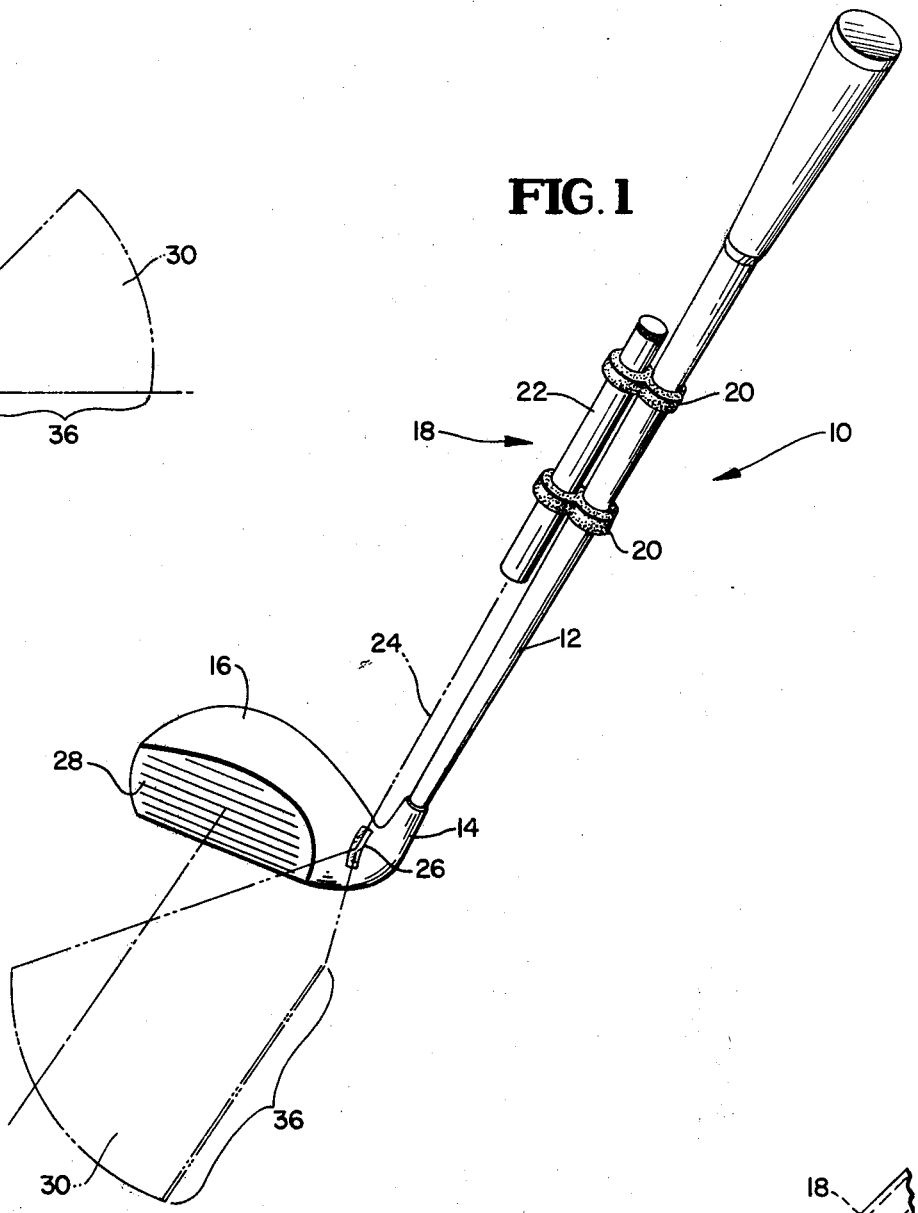
FIG. 1 is a perspective view of one embodiment of the training device and golf club.

In FIG. 1, a standard golf club 10 is illustrated, including shaft 12, hosel 14 and head 16. The type of club depicted is a driver or wood, although the invention could be used with an iron or even a putter (not shown).

A source 18 of a narrow strong pencil beam of light is secured to shaft 12 by suitable means such as a pair of resilient clips 20. In a preferred embodiment, the source 18 is a laser beam source, powered by suitable batteries (not shown) and all encased within a housing 22 arranged to project beam 24 downwardly, essentially parallel with an axis defined by shaft 12. The laser beam construction per se forms no part on the instant invention. However, it is important to note that such a beam, which has a wave length of about 6300 angstroms, this being on the orange-red border, is easily seen, even in brilliant sunlight.

A convex mirror 26 is arranged on the same side of club 10 as face 28 of head 16, approximately at the junction of hosel 14 and club head 16. Mirror 26 is mounted so as to convert pencil beam 24 into a dispersed fan of light 30, which is projected in a vertical plane (FIG. 3) through an arc of about 45° or more (FIG. 2), the vertical plane of the fan of light 30 being disposed at a 90° angle to face 28 of head 16 just before, at the precise moment of impact, golf club head and ball, and slightly afterwards as shown in FIG. 3.

Figure 2:
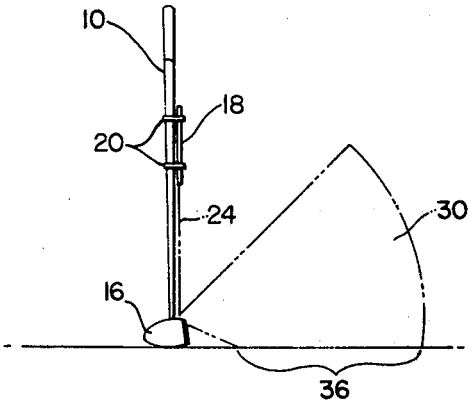
FIG. 2 is an elevation view of the invention as shown in FIG. 1.
Figure 3:
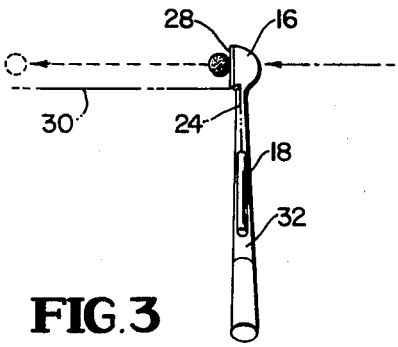
FIG. 3, is a top, plan view of another embodiment of the invention.
Figure 4:
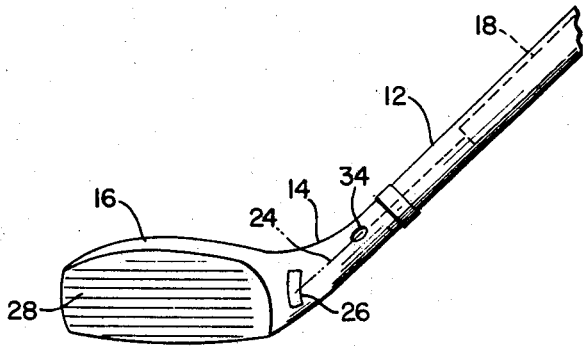
FIG. 4 is a fragmentary elevation view of the embodiment of the invention shown in FIG. 3.

In the embodiment of the invention shown in FIGS. 3 and 4 light source 18 is mounted within a hollow club shaft 32; an opening 34 is provided in the region of the hosel 14 to permit the beam of light 24 to strike mirror 26 which is secured as in the embodiment shown in FIGS. 1 and 2.

Mirror 26 could obviously be a prism with a convex face, if desired. At any rate, the term "mirror" as used herein and shown in the drawing is meant to be broad enough to include a mirror or a lens system for converting the beam of light into a projected fan of light.

As can be seen in FIG. 2, the fan of light 30 strikes the ground thus leaving a visually perceived line of light on the ground so that the golfer and/or instructor can readily seen the precise disposition of club head face 28 with respect to the ball (FIG. 3) as the ball is being struck. The several views show a golf club for a right-handed golfer; obviously the invention is suitable for either right-handed or left-handed clubs. At any rate, if the line of light 36 (FIG. 2 projected on the ground deviates out wardly from the golfer (or upwardly in the sense of FIG. 3) a slice is indicated. Conversely if line 36 deviates inwardly to the golfer (or downwardly in the sense of FIG. 3) then a hook is the result. The golfer and/or instructor may then take measures to correct the stroke. Of course, there are times on the golf course when a hook or slice stroke are most desirable for placement of the shot. This invention can be used to train a golfer's swing so that he may slice or hook at will.

The point is that, unlike prior art devices, the present invention conveys a line of sight even before the ball is struck and slightly afterwards so that the golfer may make a correction in his swing instantaneously, rather than having to wait until after the stroke is completed and then analyze the visual image in his mind created by an arc of light.

The form of the invention shown in FIGS. 1 and 2 may be attached to any club and can be marketed through pro golf shops. All that is required is an attendant to assure proper placement of the convex mirror on the golf club.

Unlike prior art devices that rely on the persistence of a mental image created by rapid tracing of an arc of light as the golf club moves through a stroke, the present invention provides an instantaneous mental image during the time of impact of club against ball. This also trains the golfer to keep his head down and his eyes on the ball; if he does not, he will not see the line at all when the ball is struck.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A golf swing training device for visually indicating to the golfer the precise angular disposition of the golf club head with respect to the golf ball at least at impact, as contact between the two is made, comprising: a source of narrow, strong pencil beam of light projected downwardly substantially parallel to the axis of the golf club shaft, said source being rigidly disposed with respect to the golf club shaft and light dispersal means arranged for disposition adjacent the face of the golf club for converting said pencil beam of light into a dispersed fan of light projecting in substantially a vertical plane forwardly from the golf club face at substantially a 90° angle thereto, at least a portion of said dispersed fan of light being projected downwardly onto the ground just before, at the moment of impact of golf club and ball during a golf swing, and slightly afterwards, whereby a visually perceivable, narrow line of light appears on the ground in front of the golf ball to inform the golfer the precise angular disposition of golf club face and ball as the ball is struck.

2. The golf swing training device as claimed in claim 1 wherein said source of a narrow, strong pencil beam of light comprises a laser beam.

3. The golf swing training device as claimed in claim 1 wherein said source of a narrow, strong pencil beam of light is located within means defining a housing having an opening at the lower end thereof for passage of said pencil beam therefrom.

4. The golf swing training device as claimed in claim 3 wherein said housing means includes means for mounting said housing means on said golf club shaft.

5. The golf swing training device as claimed in claim 3 further comprising means for mounting said housing within the shaft of said golf club.

6. The golf swing training device as claimed in claim 5 further comprising means conveying said pencil beam of light from said housing to said light dispersal means.

7. The golf swing training device as claimed in claim 1 wherein said light dispersal means comprise a single convex mirror of sufficient convex dimension to disperse said pencil beam of light through an arc of at least 45°.

* * * * *